US006524859B1

(12) United States Patent
Heese et al.

(10) Patent No.: US 6,524,859 B1
(45) Date of Patent: Feb. 25, 2003

(54) PROCESS FOR MAKING A TEXTILE PRODUCT

(75) Inventors: Werner Heese, Breisach (DE); Martin Lohe, Breisach (DE)

(73) Assignee: Madeira Garnfabrik Rudolf Schmidt KG, Freiburg (DE)

( * ) Notice: Subject to any disclaimer, the term of this patent is extended or adjusted under 35 U.S.C. 154(b) by 0 days.

(21) Appl. No.: 09/542,270

(22) Filed: Apr. 4, 2000

(30) Foreign Application Priority Data

Apr. 8, 1999 (DE) ..... 199 15 897

(51) Int. Cl.[7] ..... G01N 33/22
(52) U.S. Cl. ..... 436/56; 436/164; 427/288; 428/916
(58) Field of Search ..... 436/56, 164; 427/288; 428/916

(56) References Cited

U.S. PATENT DOCUMENTS 3,591,885 A * 7/1971 Fritzen ..... 15/210.1
3,936,556 A * 2/1976 Suling et al. ..... 428/195
3,960,755 A * 6/1976 Beachem et al. ..... 252/301.16
4,329,393 A * 5/1982 LaPerre et al. ..... 428/325
5,149,138 A * 9/1992 Zemsky ..... 283/70
6,025,200 A * 2/2000 Kaish et al. ..... 436/56
6,248,593 B1 * 6/2001 Esswein et al. ..... 436/77

FOREIGN PATENT DOCUMENTS

DE PS 501 177 6/1930

* cited by examiner

*Primary Examiner*—Jill Warden
*Assistant Examiner*—LaToya I. Cross
(74) *Attorney, Agent, or Firm*—Henry M. Feiereisen

(57) ABSTRACT

A process for marking a textile product by means of an invisible substance whose presence in the textile product is detectable by conventional detection methods of analytical chemistry, wherein the substance for marking the textile product is so selected as to be suitable for extraction from the textile product and detection through application of an absorbent probe.

4 Claims, No Drawings

PROCESS FOR MAKING A TEXTILE PRODUCT

CROSS-REFERENCES TO RELATED APPLICATIONS

This application claims the priority of German Patent Application Serial No. 199 15 897 5-26, filed Apr. 8, 1999, the subject matter of which is incorporated herein by reference.

BACKGROUND OF THE INVENTION

The present invention relates to a process for marking a textile product.

Typically, raw, semi-finished and finished textile products, e.g. yarns, fabrics and garments, are provided with labels or the like for marking the quality of the product and/or for reference to the manufacturer. However, once these identifications are removed, the manufacturer of the original product can no longer be identified or only at great difficulty. Imitations, oftentimes of low-grade quality, are thus possible without much risk, so that the manufacturers of the original goods, the following production stages or marketing stages, and possibly even the end consumer incur significant economical losses, let alone ensuing complaints and damage to the reputation.

German Pat. No. DE-PS 501 177 describes a process for marking a textile product to enable the manufacturer to ascertain whether a particular product originated from its production. This publication lists as suitable substances for marking purposes of a textile product, in particular salts, oxides or hydroxides of metal or metalloid. Detection of the substance requires the use of a sample of the textile product for subsequent incineration and testing for presence of the substance through chemical, spectroscopic or other analytical methods.

This type of marking process has been essentially ignored in commerce, because the detection for presence or absence of the marking substance is cumbersome, time-consuming, and requires complex equipment and experts to carry out the inspection.

SUMMARY OF THE INVENTION

It is thus an object of the present invention to provide an improved process for marking textile products, obviating the afore-stated drawbacks.

In particular, it is an object of the present invention to provide an improved process for marking textile products, which allows even a layman to check the presence or absence of a marking substance, without damage to the textile product, in a most simple and shortest possible manner.

These objects, and others which will become apparent hereinafter, are attained in accordance with the present invention by using a substance for marking the textile product, which substance is suitable for extraction from the textile product and detection through application of an absorbent probe.

There are many examples for such substances that are known to the person skilled in the art and can be used in the process according to the present invention, so long as the substances are toxicologically safe and do not adversely affect the quality of the textile product, on the one hand, and are detectable by simple conventional methods, on the other hand.

The process according to the present invention provides for the first time an option, even for an unskilled worker of the manufacturer or for a customs officer, to test the authenticity of textile products and thus to verify a match between the manufacturer designated for the textile product at hand and the actual manufacturer.

Suitably, the substance is of a nature that allows its detection through a color reaction.

According to another feature of the present invention, the probe may be wetted with an appropriate detection liquid before extraction of the indicator substance, to thereby yield immediately a positive or negative result. If there is, however, a risk that the reaction liquid may adversely affect the quality of the textile product (e.g. discolor the textile product), the probe may be wetted with a neutral liquid before extraction of the substance, and subsequently, i.e. after extraction, subjected to a reaction for detection. Another alternative includes the extraction of the substance by means of the probe through dry abrasion and subsequent subjection to a reaction for detection.

The probe may be configured as a swab, i.e. a wad of absorbent material (e.g. cotton) wound around one end of a small stick. Before extraction of the substance, the swab may be dipped in the neutral liquid or in the reactant liquid. Through rubbing and/or diffusion, the substance incorporated in the textile product enters the reaction liquid and generates a typical detection reaction.

Examples of substances include in particular:

- inorganic acids and lyes, and salts thereof,
- organic acids and salts thereof (e.g. ascorbic acid, fatty acids and derivates thereof),
- metals, non-metals, and compounds thereof,
- proteins, peptides, and derivates thereof,
- fats, soaps, and derivates thereof,
- indicators, e.g. phenolphtalein, thymolphtalein etc.,
- sugar and polysaccharides, starch, cellulose, and derivates thereof,
- reducing and oxidizing substances.

EXAMPLE

An indicator substance in the form of 5 g of sodium chloride is dissolved in 100 g of a preparatory agent, e.g. an emulsion for coating or brightening. The preparatory agent is applied in a manner known per se onto a textile product, e.g. yarn. Persons skilled in the art will understand that the application of this exemplified preparatory agent, which contains the indicator substance, may be implemented at any stage of the production line of the textile product. The added substance (sodium chloride) is invisible in the preparatory agent and can be detected later in the finished textile product through use of an approximately 1% solution of silver chromate in conjunction with e.g. a swab which is dipped into the red-brown silver chromate solution. After being dipped in the silver chromate solution, the swab is rubbed onto the marked textile product. As a result, the red-brown wad of the swab becomes partially or completely discolored, depending on the concentration of the contained sodium chloride, as a consequence of a reaction of the chloride ion with the silver ions, and thereby indicates the presence of the substance.

While the invention has been illustrated and described as embodied in a process for marking a textile product, it is not intended to be limited to the details shown since various modifications and structural changes may be made without departing in any way from the spirit of the present invention.

What is claimed as new and desired to be protected by Letters Patent is set forth in the appended claims:

1. A process, comprising the steps of:

adding a toxicologically safe substance to a textile product for purposes of marking the textile product, without adversely affecting the quality of the textile product; and applying an absorbent probe to extract the substance from the textile product and to detect a presence or absence of the substance, wherein the probe is rubbed on the textile product and subsequently dipped in a reaction liquid, with a discoloration of the probe indicating the presence of the substance wherein the substance is extractable by the probe through dry rubbing.

2. The process of claim 1, wherein the probe is a swab.

3. The process of claim 1, and further comprising the step of wetting the probe with a detection liquid before the applying step.

4. The process of claim 1, and further comprising the step of wetting the probe with a neutral liquid before the applying step.

* * * * *